US010233694B2

(12) United States Patent
Li et al.

(10) Patent No.: US 10,233,694 B2
(45) Date of Patent: Mar. 19, 2019

(54) DYNAMIC INWARDLY ECCENTRICALLY-PLACED DIRECTIONAL DRILL BIT TYPE ROTATION GUIDANCE APPARATUS

(71) Applicant: SOUTHWEST PETROLEUM UNIVERSITY, Chengdu (CN)

(72) Inventors: Wei Li, Chengdu (CN); Hongxiang Lei, Chengdu (CN); Qingyou Liu, Chengdu (CN); Shihong Xiao, Chengdu (CN); Xu Si, Chengdu (CN); Tieshan Zhang, Chengdu (CN); Qing Tu, Chengdu (CN); Xiao Tan, Chengdu (CN); Fanyao Jin, Chengdu (CN); Xingming Wang, Chengdu (CN); Yuan Zhong, Chengdu (CN); Hang Li, Chengdu (CN); Jianchuan Wu, Chengdu (CN); Dengwei Li, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 32 days.

(21) Appl. No.: 15/323,104

(22) PCT Filed: Jun. 23, 2015

(86) PCT No.: PCT/CN2015/082089
§ 371 (c)(1),
(2) Date: Dec. 30, 2016

(87) PCT Pub. No.: WO2016/015528
PCT Pub. Date: Feb. 4, 2016

(65) Prior Publication Data

US 2018/0100352 A1 Apr. 12, 2018

(30) Foreign Application Priority Data

Jul. 28, 2014 (CN) ..... 2014 1 0361802

(51) Int. Cl.
*E21B 7/06* (2006.01)
*E21B 7/04* (2006.01)
*E21B 34/06* (2006.01)

(52) U.S. Cl.
CPC ..... *E21B 7/064* (2013.01); *E21B 7/04* (2013.01); *E21B 7/068* (2013.01); *E21B 34/06* (2013.01)

(58) Field of Classification Search
CPC . E21B 7/064; E21B 7/04; E21B 7/068; E21B 34/06
See application file for complete search history.

(56) References Cited

U.S. PATENT DOCUMENTS 2,002,385 A * 5/1935 Bannister ..... E21B 4/14 173/73
3,799,277 A 3/1974 Kellner
(Continued)

FOREIGN PATENT DOCUMENTS

CN 2431391 Y 5/2001
CN 2535541 Y 2/2003
(Continued)

*Primary Examiner* — Yong-Suk Ro
(74) *Attorney, Agent, or Firm* — Gokalp Bayramoglu

(57) ABSTRACT

A rotation guidance apparatus belonging to the technical field of oil drilling equipment. An end part of a lower connector has a ball-socketed ball-joint rod, and a drill bit is connected to the ball-socketed ball-joint rod. Several circumferentially and evenly distributed piston holes are provided in a side wall of the lower connector, wherein a piston matches each piston hole and a piston rod connected to the piston is movably connected to the ball-socketed ball-joint rod. An eccentrically-placed valve core is connected to a controller provided in an upper connector, wherein a working face of the eccentrically-placed valve core is opposite to the piston holes and rotation of the eccentrically-placed
(Continued)

valve core makes the pistons in the piston holes move to control the rotation guidance of the ball-socketed ball-joint rod.

16 Claims, 2 Drawing Sheets

(56) References Cited

U.S. PATENT DOCUMENTS

| | | | | |
|---|---|---|---|---|
| 6,047,784 | A * | 4/2000 | Dorel | E21B 7/068 175/61 |
| 6,269,883 | B1 * | 8/2001 | Gissler | E21B 17/023 166/241.5 |
| 2014/0199196 | A1 | 7/2014 | Twardowski | |

FOREIGN PATENT DOCUMENTS

| | | | |
|---|---|---|---|
| CN | 104265168 | A | 1/2015 |
| GB | 1139908 | A | 1/1969 |

* cited by examiner

DYNAMIC INWARDLY ECCENTRICALLY-PLACED DIRECTIONAL DRILL BIT TYPE ROTATION GUIDANCE APPARATUS

CROSS REFERENCE TO RELATED APPLICATIONS

This application is the national phase entry of International Application No. PCT/CN2015/082089, filed on Jun. 23, 2015, which is based upon and claims priority to Chinese Patent Application No. CN201410361802.5 filed on Jul. 28, 2014, the entire contents of which are incorporated herein by reference.

TECHNICAL FIELD

The present invention relates to the field of oil drilling equipment, in particular to a closed-loop rotation guidance drilling technology.

BACKGROUND ART

In recent ten years, with rapid development of a horizontal well, an extended-reach well, a multilateral well and other complex structural wells as well as "offshore oil production on land" and shale gas development, and upon the requirements of a drilling technology to reduce the efficiency, reducing the cost, improving the drilling capacity, etc., under severe environments and complicated geological conditions, the research about the rotation guidance drilling technology has been developed both in China and abroad. The rotation guidance drilling technology is a new cutting-edge automatic drilling technology. Proved by drilling practices in China and abroad, when the rotation guidance drilling technology is promoted and applied in a horizontal well, an extended-reach well, a highly-deviated well and a three-dimension multi-target well, the drilling speed is improved and the drilling failure is also reduced, thereby reducing the drilling cost. A rotation guidance drilling tool serves as a core of a rotation guidance drilling system and decides operating features and the operating capacity of the rotation guidance drilling system.

A rotation guidance technology is used to drill a well with a rotary table (or top drive) rotary drill stem and realizes a corresponding guidance function while drilling. The rotation guidance technology has the following advantages of: eliminating sliding drilling, reducing torque and friction drag, enhancing hole quality, improving hole cleanness, increasing penetration rate, reducing equivalent circulation density, selecting optimal drilling parameters to obtain maximum penetration rate, reducing risk of differential pressure sticking, making the selection for drilling performance of a drill bit be superior to the selection for the guidable property of the drill bit, realizing directional control over the whole drilling course of the extended-reach well, drilling a majority of wells having high difficulty well track at low risk and saving drilling time. Moreover, the well depth limit may reach 15 km, and the drilling cost is low. Therefore, the rotation guidance drilling technology is an inevitable direction in the development of modern guidance drilling technologies.

At present, three major oil companies abroad, Baker-Hughes, Schlumberger and Halliburton have respectively formed PowerDriveSRD, AutoTrakRCLS and Geo-Pilot rotation guidance drilling systems for respective commercial application by means of various ways, and the foundational difference of the three systems is that downhole drilling tools are different, which fully explains that the rotation guidance drilling tool serves as a core of a rotation guidance drilling system. The two former systems may be classified into one system, namely push-the-bit rotation guidance drilling system; and the latter system belongs to a point-the-bit rotation guidance drilling system. The push-the-bit rotation guidance system has large lateral force and high deflection rate, but holes drilled by rotation guidance have large doglegs and track fluctuation and are not smooth, and a drill bit and a drill bit bearing are worn more seriously. The point-the-bit rotation guidance system has the capability of drilling relatively smooth holes with smaller friction drag and torque, may make use of a relatively high drilling pressure, has relatively high penetration rate, and is conducive to developing the performances of a drill bit, the lateral load borne by the drill bit and a bearing thereof is relatively small, the ultimate displacement increases, but the deflection rate is relatively low. At present, the push-the-bit rotation guidance system has basically matured in technology, however, the point-the-bit rotation guidance system still is at a start stage.

It was lately that the research in this field began to develop, and it was in full swing in the 1990s. A technical team led by academician, Yinao Su successfully developed a CGDS-1 near-bit geosteering rotary drilling system, 15 wells being applied in oil fields, such as Jidong and Liaohe. Moreover, a research team led by professor, Shaohuai Zhang, also gained breakthroughs in the aspect of rotation guidance drilling in cooperation with Shengli Oil Field of Sinopec. But a majority of researches focused on push-the-bit rotation guidance drilling, and the search on point-the-bit rotation guidance drilling was at a bottlenecked state in China.

SUMMARY OF THE INVENTION

Technical Problems

The present invention aims to provide a directional rotation guidance apparatus against the above-mentioned problems, which breaks through the problems in existing push-the-bit rotation guidance in China that the lateral force is large, the deflection rate is high, the drilled holes have large doglegs and track fluctuation and are not smooth, and a drill bit and a drill bit bearing are worn more seriously, and is of a design thought which is simpler in structure, easier to control and higher in reliability compared to a directional rotation guidance apparatus abroad. A new dynamic inwardly eccentrically-placed drill bit type (fully rotating, and a radial dimension of a tool will not undergo a locally expanded phenomenon) rotation guidance apparatus is formed in order to avoid the shortcomings existing in a static eccentrically-placed push-the-bit drill bit type (an outer barrel of a tool system does not rotate, for example, Auto TrakRCLS), a dynamic eccentrically-placed push-the-bit drill bit type (fully rotating, for example, Power Drive SRD), a static eccentrically-placed directional drill bit type (an outer barrel of a tool system does not rotate, for example, Geo-Pilot) and the like in the existing conventional rotation guidance technology. By providing an rotary eccentrically-placed valve core in a position, close to a drill bit side, of a drill stem to push a hydraulic piston push rod type rotation guidance apparatus to make a ball joint provided with a drill bit circumferentially rotate at 360 degrees within a certain deviation angle range, a brand-new directional rotation guidance apparatus is provided, which may control a "rocking back and forth" cycle of the drill bit by means of the rotation of the eccentrically-placed valve core and control the amplitude of the "rocking back and forth" of the drill bit by means of the axial motion of the eccentrically-placed valve core. When the eccentrically-placed valve core is entirely pulled back away from the piston holes, the drill bit can be used for straight drilling or stable inclination, and the nearer the eccentrically-placed valve core approaches the hydraulic piston holes, the stronger the deflection capacity, which can satisfy drilling of different radii of curvature; and therefore, the rotation guidance may be applicable to drilling of large curvature, and also may be used for drilling under a mean curvature and a small curvature, without a problem that a local radial dimension of a tool is expanded in a drilling process, such that a channel from which rock debris is discharged is more smooth, and the drilling safety and reliability are improved. Because of full rotation, the friction force between the drill stem and a well wall is reduced, and a horizontal well section may extend more deeply.

Solutions to Problems

Technical Solutions

The technical solutions adopted in the present invention are as follows:

a rotation guidance apparatus of the present invention comprises an upper connector and a lower connector which are connected to each other, wherein an end part of the lower connector has a ball-socketed ball-joint rod, and a drill bit is connected to the ball-joint rod; several circumferentially evenly distributed piston holes are provided in a side wall of the lower connector, a piston matches each piston hole, and a piston rod connected to the piston is movably connected to the ball-joint rod; and an eccentrically-placed valve core is connected to a controller provided in the upper connector, a working face of the eccentrically-placed valve core is opposite to the piston holes, and rotation of the eccentrically-placed valve core makes the pistons in the piston holes move to control the rotation guidance of the ball-joint rod.

Due to the adoption of said structure, the drill bit is mounted on the ball-joint rod, and the ball-joint rod is ball-socketed (connected by adopting a ball-joint structure) to the lower connector, such that the ball-joint rod may circumferentially rotate at 360 degrees within a certain deviation angle range by taking the ball-joint structure as a center. The deviation angle range is limited by a motion range of the ball-joint rod and is limited to a position, movably connected to the ball-joint rod, of the piston rod in the present invention and may be set as required, and therefore, the ball-joint rod may drive the drill bit to circumferentially rotate at 360 degrees within a certain deviation angle range according to the property of the ball-joint rod which can circumferentially rotate at 360 degrees within a certain deviation angle range, thereby solving the problem that a diameter variable stabilizer in the prior art can only be used for performing fine tuning on well deviation and only can be applicable to drilling of large curvature when used in a drilling process. In order to realize circumferential rotation of the ball-joint rod at 360 degrees within a certain deviation angle range, it is necessary to apply a bias force to the ball-joint rod in a drilling process, and the bias force of the ball-joint rod is derived from piston rods in the piston holes, with more than three piston rods being provided, wherein a mud pressure intensity P at an end, close to the drill bit, of each piston rod is basically the same, and the mud pressure intensity P at the other end of the piston rod is variable; and the varied mud pressure intensity P is caused by rotary motion and axial motion of the eccentrically-placed valve core, and the motion of the eccentrically-placed valve core is controlled by a controller. The rotary motion of the eccentrically-placed valve core is for a purpose of making the forces borne by the piston vary with the rotary motion of the eccentrically-placed valve core in sequence. In the rotation process of the eccentrically-placed valve core, the entire axial displacement between the valve core and a valve seat is constant, but a relative distance between a concave part on the valve core and the valve seat is farther, a relatively large pressure intensity may be produced at this part; and a convex part of the valve core is closer to the valve seat, and the pressure intensity at this part is relatively reduced. When the valve core rotates, a pressure circulating field of which a pressure intensity varies in sequence and which is rotating is formed around the valve core, such that the forces borne by the pistons vary in sequence, and therefore, the ball-joint rod and the drill bit connected to the ball-joint rod continuously swing as the forces vary. Therefore a working force of the eccentrically-placed valve core is required to correspond to the piston holes. The axial motion of the eccentrically-placed valve core is for a purpose of making the forces borne by the more than three pistons vary in an amplitude of the bias angle along with the axial motion of the eccentrically-placed valve core. That is, the axial motion of the eccentrically-placed valve core determines large-scale adjustment of the bias angle of the drill bit, the rotary motion of the eccentrically-placed valve core determines a rotation speed of the bias angle of the drill bit, and when this speed reaches a certain relation to the rotation speed of the drill stem, the drill bit drills towards one direction (generally speaking, the rotary motion of the eccentrically-placed valve core controls a "rocking back and forth" cycle of the drill bit and the axial motion of the eccentrically-placed valve core controls the amplitude of the "rocking back and forth" of the drill bit. The rotation guidance apparatus of the present invention breaks through the problems in existing push-the-bit rotation guidance in China that the lateral force is large, the deflection rate is high, the drilled holes have large doglegs and track fluctuation and are not smooth, and a drill bit and a drill bit bearing are worn more seriously, and is of a design thought which is simpler in structure, easier to control and higher in reliability compared to a directional rotation guidance apparatus abroad. A new dynamic inwardly eccentrically-placed drill bit type (fully rotating, and a radial dimension of a tool will not undergo a locally expanded phenomenon) rotation guidance apparatus is formed in order to avoid the shortcomings existing in a static eccentrically-placed push-the-bit drill bit type (an outer barrel of a tool system does not rotate, for example, Auto TrakRCLS), a dynamic eccentrically-placed push-the-bit drill bit type (fully rotating, for example, Power Drive SRD), a static eccentrically-placed directional drill bit type (an outer barrel of a tool system does not rotate, for example, Geo-Pilot) and the like in the existing conventional rotation guidance technology. By providing an rotary eccentrically-placed valve core in a position, close to a drill bit side, of a drill stem to push a hydraulic piston push rod type rotation guidance apparatus to make a ball joint provided with a drill bit circumferentially rotate at 360 degrees within a certain deviation angle range, a brand-new directional rotation guidance apparatus is provided, which may control a "rocking back and forth" cycle of the drill bit by means of the rotation of the eccentrically-placed valve core and control the amplitude of the "rocking back and forth" of the drill bit by means of the axial operation of the eccentrically-placed valve core. When the eccentrically-placed valve core is entirely pulled back away from the piston holes, the drill bit can be used for straight drilling or stable inclination, and the nearer the eccentrically-placed valve core approaches the hydraulic piston holes, the stronger the deflection capacity, which can satisfy drilling of different radii of curvature. Therefore, the rotation guidance apparatus may be applicable to drilling of large curvature, and also may be used for drilling under a mean curvature and a small curvature, without a problem that a local radial dimension of a tool is expanded in a drilling process, such that a channel from which rock debris is discharged is more smooth, and the drilling safety and reliability are improved. Because of full rotation, the friction force between the drill stem and a well wall is reduced, and a horizontal well section may extend more deeply.

According to the rotation guidance apparatus of the present invention, the eccentrically-placed valve core is of a conical structure, a cone surface of the eccentrically-placed valve core is provided with a concave part and a convex part which are adjoined to each other, wherein the convex part is close to the top of the eccentrically-placed valve core, the concave part is close to the bottom of the eccentrically-placed valve core, and the cone surface of the eccentrically-placed core is aligned to the piston holes.

Due to the adoption of said structure, as a component mainly used for controlling the piston rods to move, the eccentrically-placed valve core is mainly used to form a pressure circulating field of which a pressure intensity varies in sequence and which is rotating around the valve core, such that the forces borne by three or more piston rods vary in sequence, and therefore, the ball-joint rod and the drill bit connected to the ball joint rod continuously swing as the forces vary. Therefore, the requirement to the structure of the eccentrically-placed valve core is relatively special, and in the present invention, the eccentrically-placed valve core is made into a conical structure, and a working face thereof is an inclined surface of the eccentrically-placed valve core. In order to reach said effect, it is necessary to provide a concave part and a convex part on the same cone generatrix of the inclined surface of the eccentrically-placed valve core, wherein the convex part is close to the top of the eccentrically-placed valve core, the concave part is close to the bottom of the eccentrically-placed valve core, that is, a relative distance between the concave part on the valve core and the valve seat (an inclined matching surface on an inner wall of the lower connector) is farther, and a relatively large pressure intensity may be generated at this part. The convex part of the valve core is closer to the valve seat (an inclined matching surface on an inner wall of the lower connector), and the pressure intensity at this part is relatively reduced. When mud passes through the upper connector and the lower connector and impacts the inclined surface of the eccentrically-placed valve core, the direction of a part of mud may vary by the convex part and the concave part, such that the concave part of the eccentrically-placed valve core is aligned to the piston holes, thereby forming a pressure circulating field of which a pressure intensity varies in sequence and which is rotating around the valve core; and in this way, the forces borne by the three (or more) piston rods vary in sequence when the eccentrically-placed valve core is aligned to the piston holes, thereby driving the piston rods to relatively move, and therefore, the ball-joint rod and the drill bit connected to the ball-joint rod continuously swing as the forces vary.

According to the rotation guidance device of the present invention, one end of the ball-joint rod is configured into a spherical structure which may be matched with an end part of the lower connector by adopting a spherical surface to form a ball-joint structure. The ball-joint rod may rotate relative to the lower connector by taking the ball-joint structure as a center, wherein the ball-joint rod is communicated with a central through hole of the lower connector to each other; and a spline disc head is sheathed outside the middle part of the ball joint rod, wherein the piston rod that matches each piston hole is connected to the spline disc head.

Due to the adoption of said structure, the drill bit is mounted on an extending tip of the ball-joint rod through an adapter, and the other tip of the ball-joint rod is configured into a spherical structure, such that the spherical tip contacts a mouth part surface of the central through hole in the upper end part of the lower connector to form a ball-joint structure, and therefore the ball-joint rod may circumferentially rotate at 360 degrees within a certain deviation angle range by taking the ball-joint structure as a center. The size of the deviation angle mainly depends on the interference of the lower connector to the ball-joint rod and may be adjusted according to the curvature of drilling. When the swing amplitude of the drill bit is required to be smaller, the deviation angle is also required to be smaller, and when the swing amplitude of the drill bit is required to be larger, the deviation angle is required to be larger. Therefore, the rotation direction of the drill bit is controlled by controlling the rotation of the ball-joint rod at 360 degrees in the circumferential direction, thereby realizing a rotation guidance role. In order to ensure that the mud can pass through normally in a guidance process, the ball-joint rod is made into a hollow structure. The spline disc head is sheathed outside the middle part of the ball-joint rod, such that the piston rods are movably connected to the edge position thereof, such that the ball-joint rod is controlled to deflect by the spline disc head when the pistons drive the piston rods to move, thereby realizing the control over the rotation guidance of the drill bit.

According to the rotation guidance apparatus of the present invention, a large ball joint gland connected to the lower connector is sheathed outside the ball-joint structure; a gland nut for limiting the spline disc head is sheathed outside the middle part of the ball-joint rod; and an anti-drop connector which is sheathed outside the ball-joint rod is connected to one end, close to the drill bit, of the lower connector, and the minimum drift diameter of the anti-drop connector is greater than the outer diameter of the spline disc head.

Due to the adoption of said structure, the large ball joint gland is mainly used to limit an end bulb of the ball-joint rod to avoid the disconnection between the ball-joint rod and the lower connector; and the gland nut is mainly used to lock the spline disc head on the ball-joint rod to avoid the disconnection of the spline disc head from the ball-joint rod. The anti-drop connector is connected to the lower connector through threads to prevent the ball joint and the drill bit from falling into a well after the piston rods are broken; and the outer diameter of the spline disc head is less than the minimum inner draft diameter of the anti-drop connector.

According to the rotation guidance device of the present invention, one end of each piston rod is ball-socketed to the spline disc head, a piston rod upper sealing packing is provided at the other end of the piston rod to form a piston, and the piston rod may drive the piston rod upper sealing packing to move relative to the piston holes; and a piston rod lower sealing packing which may move in a relative sealing manner is sheathed outside the piston rod, and is fixed to the lower connector.

Due to the adoption of said structure, each piston rod is provided with the piston rod upper sealing packing to form the piston which may drive the piston rod to move relative to the piston holes when a pressure field P generated by the rotation of the eccentrically-placed valve core varies, and then, the other end of the piston rod drives the spline disc head through the ball joint structure and transfers a torque to the ball-joint rod; and therefore, in order to avoid the piston rods from being interfered when driving the spline disc head, it is necessary to adopt the ball-joint structure to connect the piston and the spline disc head, such that the piston rod and the spline disc head may rotate oppositely or rotate in a swinging manner. The piston rod lower sealing packing may form dynamic sealing with the piston rods to prevent sundries from entering into the piston holes.

According to the rotation guidance device of the present invention, an accommodating groove which is communicated with the piston hole is provided in a position, in the middle of each piston hole, of the lower connector, and a hydraulic bag is provided inside the accommodating groove and is sealed in the accommodating groove via a hydraulic bag gland.

Due to the adoption of said structure, the accommodating groove is also provided in a position, in the middle of each piston hole, of the lower connector, wherein the hydraulic bag is provided in the accommodating groove and is sealed inside the groove of a shell via the hydraulic bag. The hydraulic bag has a function of storing hydraulic oil between each piston rod and the corresponding piston hole of the shell, such that the piston rod and the sealing packing provided thereon are likely to undergo relative sliding as the pressure field P varies, thereby controlling the drill bit to swing by transferring a torque, via the spline disc head, to the ball-joint rod.

According to the rotation guidance apparatus of the present invention, a central hole for accommodating a controller is provided in the center of the upper connector, several bypass holes which are located in the same circumference are provided in a side wall of the upper connector, and the bypass holes, the central through hole of the lower connector and the central through hole of the ball-joint rod are communicated relatively to form a channel; and the eccentrically-placed valve core is located in a region, where the lower connector and the upper connector are connected, inside the channel.

Due to the adoption of said structure, the bypass holes are mainly used to allow mud in the upper connector to pass through, and therefore the bypass holes need to be communicated with the central through hole of the lower connector and the central through hole of the ball-joint rod to form a channel convenient for mud to pass through in a drilling process; and the eccentrically-placed valve core is also provided inside the channel, and is located in a region, where the lower connector and the upper connector are connected, for convenience in disassembly and assembly.

According to the rotation guidance device of the present invention, the controller comprises a rotating motor and a dragging motor which are located on the same axis inside the center hole. The eccentrically-placed valve core is provided at one end of an eccentrically-placed valve rod, the other end of the eccentrically-placed valve rod is connected to the rotating motor through a transmission shaft I, and the rotating motor is connected to the dragging motor through a transmission shaft II. A control module is placed in a region, where a groove is formed, on the side wall of the upper connector, and the rotating motor and the dragging motor are connected to and controlled by the control module respectively.

Due to the adoption of the structure, the rotating motor may drive the eccentrically-placed valve rod to rotate through the transmission shaft I and then control the eccentrically-placed valve core on the eccentrically-placed valve rod to rotate, thereby realizing the control over a reciprocating motion of the piston rods and finishing the control over the swinging of the ball-joint rod. However, the dragging motor drives the rotating motor and the eccentrically-placed valve core to relatively move inside the upper connector through the transmission shaft II, thereby controlling a relative position between the eccentrically-placed valve core and the valve seat, controlling the motion amplitude of the piston rods and then controlling the swinging amplitude of the drill bit. Therefore, the axial motion of the eccentrically-placed valve core determines a large-scale adjustment to the bias angle of the drill bit, and the rotary motion of the eccentrically-placed valve core determines a rotation speed of the bias angle of the drill bit. When this rotation speed reaches a certain relation with the rotation speed of the drill stem, the drill bit drills towards one direction (generally speaking, the rotary motion of the eccentrically-placed valve core controls a "rocking back and forth" cycle of the drill bit, and the axial motion of the eccentrically-placed valve core controls the amplitude of the "rocking back and forth" of the drill bit). The groove which is provided in a region, close to the rotating motor, of the upper connector is configured to install the control module, said region being sealed by a control region gland. The rotating motor, the control module and the dragging motor are communicated by a signal channel, wherein a terminal of the signal channel is blocked by a signal channel plug (which may be directly sealed by welding after drilled through), and the signal channel is provided with a signal interface for information transfer with outside.

According to the rotation guidance device of the present invention, a motor sleeve I and a motor support are provided in the central hole; the rotating motor is clamped inside the motor sleeve I, and bumps are provided outside the motor sleeve I and match a motor sleeve sliding groove in an inner wall of the central hole, such that the motor sleeve I may slide relative to the central hole; and a motor sleeve end cover I is provided at a tail part of the motor sleeve I and matches the transmission shaft II through threads, and the transmission shaft II is connected to the dragging motor provided inside a motor sleeve II.

Due to the adoption of said structure, the rotating motor is installed inside the motor sleeve II and is provided with a groove, such that the rotating motor is just inserted into a motor key groove of the motor sleeve and then relatively fixed with the motor sleeve I via the key groove and transfers a torque, and two bumps (lugs) which are circumferentially provided on the motor sleeve I are just inserted into the motor sleeve sliding groove provided at the central hole of the upper connector. An end part of the motor sleeve I extends out of the upper connector, the lower end of a valve core rod is coupled to the eccentrically-placed valve core through threads, the upper end of the valve core rod is coupled to the transmission shaft I through threads, a motor output shaft is clamped into the transmission shaft I, a shoulder of the transmission shaft I is constrained by a bearing set I, and the bearing set I is pressed on the motor sleeve by a valve core rod sealing packing. The rotating motor, the motor sleeve I and the valve core rod, the bearing set I, the transmission shaft I, the valve core rod sealing packing and the eccentrically-placed valve core that are attached to the motor sleeve I can be entirely and axially dragged by the dragging motor. Such dragging means that the dragging motor drives the transmission shaft II to rotate. Because the motor sleeve end cover I and the transmission shaft II are connected through threads and the motor sleeve end cover I and the motor sleeve I can merely slide relative to the upper connector, rather than relatively rotating, an entire axial dragging effect of the motor can be achieved. The dragging motor is clamped into the motor sleeve II, the motor sleeve is mounted on the motor support, the motor support is coupled to an upper position of the central hole of the upper connector through threads and is pressed by a motor sleeve end cover II, and the motor sleeve end cover II is connected to the motor support through threads. Trapezoidal threads are provided at an upper end of the motor sleeve end cover I in a turning manner and match the threads at a lower end of the transmission shaft II to play a role of converting the rotary motion into the axial motion. The transmission shaft II is constrained by a limiting spacer ring I, a limiting spacer ring II, steps in the middle of the central hole of the upper connector, and a lower end part of the motor support.

Beneficial Effect of the Present Invention

From the above, due to the adoption of the above-mentioned technical solutions, the present invention has the following beneficial effects:

1. The rotation guidance apparatus of the present invention breaks through the problems in existing push-the-bit rotation guidance in China that the lateral force is large, the deflection rate is high, the drilled holes have large doglegs and track fluctuation and are not smooth, and a drill bit and a drill bit bearing are worn more seriously, and is of a design thought which is simpler in structure, easier to control and higher in reliability compared to a directional rotation guidance apparatus abroad.

2. A new dynamic inwardly eccentrically-placed drill bit type (fully rotating, and a radial dimension of a tool will not undergo a locally expanded phenomenon) rotation guidance apparatus is formed in order to avoid the shortcomings existing in a static eccentrically-placed push-the-bit drill bit type (an outer barrel of a tool system does not rotate, for example, Auto TrakRCLS), a dynamic eccentrically-placed push-the-bit drill bit type (fully rotating, for example, Power Drive SRD), a static eccentrically-placed directional drill bit type (an outer barrel of a tool system does not rotate, for example, Geo-Pilot) and the like in the existing conventional rotation guidance technology. By providing an rotary eccentrically-placed valve core in a position, close to a drill bit side, of a drill stem to push a hydraulic piston push rod type rotation guidance apparatus, a ball joint provided with a drill bit may circumferentially rotate at 360 degrees within a certain deviation angle range.

3. The rotation guidance device of the present invention may control a "rocking back and forth" cycle of the drill bit by means of the rotation of the eccentrically-placed valve core and control the amplitude of the "rocking back and forth" of the drill bit by means of the axial motion of the eccentrically-placed valve core. When the eccentrically-placed valve core is entirely pulled back away from the piston holes, the drill bit can be used for straight drilling or stable inclination, and the nearer the eccentrically-placed valve core approaches the hydraulic piston holes, the stronger the deflection capacity, which can satisfy drilling of different radii of curvature.

4. The rotation guidance device of the present invention may be applicable to drilling of large curvature, and also may be used for drilling under a mean curvature and a small curvature, without a problem that a local radial dimension of a tool is expanded in a drilling process, such that a channel from which rock debris is discharged is more smooth, and the drilling safety and reliability are improved. Because of full rotation, the friction force between the drill stem and a well wall is reduced, and a horizontal well section may extend more deeply.

DETAILED DESCRIPTION OF THE DRAWINGS

Figure 1:
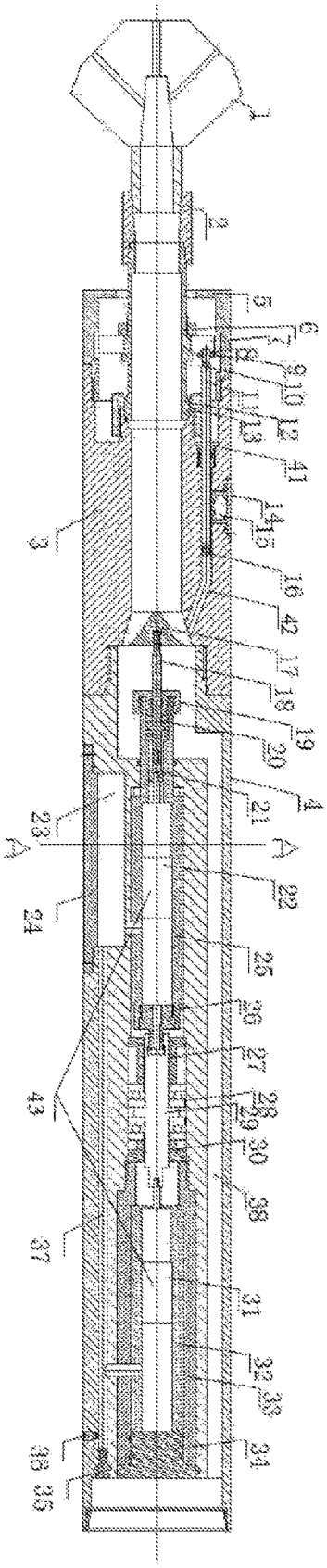
FIG. 1 is a structural schematic drawing of the hydraulic piston push rod type rotation guidance apparatus pushed by the rotation of the eccentrically-placed valve core according to the present invention.

In figures, the drill bit 1, the adapter 2, the lower connector 3, the upper connector 4, the anti-drop connector 5, the gland nut 6, the spline disc head 7, the small ball joint 8, the small ball joint gland 9, the dowel 10, the piston rod 11, the ball-joint rod 12, the large ball joint gland, the hydraulic bag gland 14, the hydraulic bag 15, the piston rod upper sealing packing 16, the eccentrically-placed valve core 17, the eccentrically-placed valve rod 18, the valve core rod sealing packing 19, the bearing set I 20, the transmission shaft I 21, the rotating motor 22, the control module 23, the control region gland 24, the motor sleeve I 25, the motor sleeve end cover I 26, the limiting spacer ring I 27, the bearing seat II 28, the transmission shaft II 29, the limiting spacer ring II 30, the dragging motor 31, the motor sleeve II 32, the motor support 33, the motor sleeve end cover II 34, the signal channel plug 35, the signal interface 36, the signal channel 37, the bypass hole 38, the motor key groove 39, the motor sleeve sliding groove 40, the piston rod lower sealing packing 41, the piston hole 42 and the controller 43 are shown.

In addition to mutually exclusive features and/or steps, all the features or all the steps in methods or processes disclosed in the description may be combined in any forms.

Any feature disclosed in the description (including any attached claims and abstract) may be, unless specially described, replaced by other equivalent or substitutive features having similar purpose. That is, unless specially described, each feature is merely an example among a series of equivalent or similar features.

Figure 2:
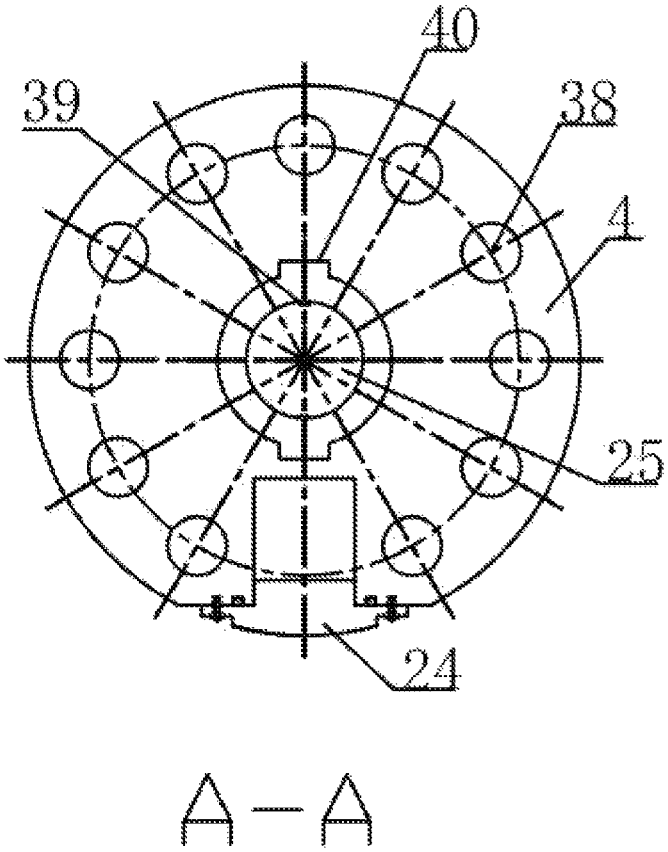
FIG. 2 is a sectional drawing of A-A in FIG. 1.

As shown in FIG. 1 and FIG. 2, the rotation guidance apparatus of the present invention comprises an upper connector 4, a lower connector 3 and a ball-joint rod 12. The upper connector 4 is connected to the lower connector 3 through threads; a central through hole is provided in the center of each of the lower connector 3 and the ball-joint rod 12. More than three through piston holes 42 that are located in the same circumference are evenly distributed in a side wall of the lower connector 3, a piston which can relatively move matches each piston hole 42, and the piston is ball-socketed (socketing is merely a manner and other similar movable connection manners are also available) to the spline disc head 7 via a piston rod 11. The spline disc head 7 is sheathed outside the ball-joint rod 12 (according to the action of the spline disc head, the function of the piston rods may be also achieved by providing a circular boss outside the middle part of the ball-joint rod and movably connecting the piston rod 11 to the edge of the boss). One end of the ball-joint rod 12 is ball-socketed into the lower connector 3, and the other end of the ball-joint rod 12 is connected to a drill bit 1 through an adapter 2. One end of the ball-joint rod 12 is configured into a spherical structure which may be matched with an end part of the lower connector 3 by adopting a spherical surface to form a ball-joint structure, such that the ball-joint rod 12 may rotate relative to the lower connector 3 by taking the ball joint structure as a center, wherein the ball-joint rod 12 is correspondingly communicated with the central through hole of the lower connector 3, and a large ball joint gland 13 connected to the lower connector 3 is sheathed outside the ball-joint structure. The spline disc head 7 and a gland nut 6 are sheathed in the middle of the ball-joint rod 12, wherein the gland nut 6 is configured to lock the spline disc head 7 on the ball-joint rod 12. An anti-drop connector 5 is connected to one end, close to the drill bit, of the lower connector 3, the ball joint rod 12 passes through the anti-drop connector 5, and the minimum drift diameter of the anti-drop connector 5 is greater than the outer diameter of the spline disc head 7. An accommodating groove which is communicated with the piston hole 42 is provided in a position, in the middle of each piston hole 42, of the lower connector 3, and a hydraulic bag 15 is provided inside the accommodating groove and is sealed in the accommodating groove via a hydraulic bag gland 14. A central hole for accommodating a controller 43 is provided in the upper connector 4, several bypass holes 38 which are located in the same circumference are provided in a side wall of the upper connector 4, and the bypass holes 38, the central through hole of the lower connector 3 and the central through hole of the ball-joint rod 12 are communicated relatively to form a channel. The eccentrically-placed valve core 17 is located in a region, where the lower connector 3 and the upper connector 4 are connected, inside the channel. The eccentrically-placed valve core 17 is of a conical structure, a cone surface of the eccentrically-placed valve core 17 is provided with a concave part and a convex part which are adjoined to each other, wherein the convex part is close to the top of the eccentrically-placed valve core 17, and the concave part is close to the bottom of the eccentrically-placed valve core 17. The convex part and the concave part are placed on the same conical generatrix, such that an eccentric structure is formed on the eccentrically-placed valve core 17. A cone surface of the eccentrically-placed valve core 17 corresponds to the piston holes 42, and the piston rod 11 matches each piston hole 42. One end of each piston rod 11 is ball-socketed to the spline disc head 7, and a piston rod upper sealing packing 16 is provided at the other end of the piston rod to form a piston, such that the piston rod 11 may drive the piston rod upper sealing packing 16 to move relative to the piston hole 42. A piston rod lower sealing packing 41 is sheathed outside each piston rod 11 and is fixed to the lower connector 3, such that the piston rod 11 may move relative to the piston rod lower sealing packing 41. The eccentrically-placed valve core 17 is connected to and controlled by a rotary dragging controller 43 through the eccentrically-placed valve rod 18. The rotary dragging controller 43 is provided in the central hole and comprises a rotating motor 22 and a dragging motor 31 which are located on the same axis. The eccentrically-placed valve core 17 is provided at one end of the eccentrically-placed valve rod 18, the other end of the eccentrically-placed valve rod 18 is connected to the rotating motor 22 through a transmission shaft I 21, and the rotating motor 22 is connected to the dragging motor 31 through a transmission shaft II 29. A control module 23 is placed in a region, where a groove is formed, on the side wall of the upper connector 4, and the rotating motor 22 and the dragging motor 31 are connected to and controlled by the control module 23 respectively. A motor sleeve I 25 for accommodating the rotating motor 22 and a motor support 33 for accommodating the motor sleeve II 32 are provided in the central hole. The motor support 33 is connected to an inner wall of the central hole through threads. The rotating motor 22 is clamped inside the motor sleeve I 25, and bumps which are circumferentially provided on the motor sleeve I 25 are placed in a motor sleeve sliding groove in an inner wall of the central hole, such that the motor sleeve I 25 may slide relative to the central hole; and a motor sleeve end cover I 26 is provided at a tail part of the motor sleeve I 25 and matches the transmission shaft II 29 through threads, and the transmission shaft II 29 is connected to the dragging motor 31 provided inside a motor sleeve II 32.

In the present invention, the drill bit is installed on the ball-joint rod, and the ball-joint rod which is hollow and allows mud to pass through may circumferentially rotate at 360 degrees along a certain deviation angle range. The bias force of the ball-joint rod is derived from three (or more) piston rods linked to the ball joint, wherein a mud pressure intensity P of an end, close to the drill bit, of each piston rod is basically the same, and the mud pressure intensity P at the other end of the piston rod is variable. The variation of the mud pressure intensity P at the other end of the piston rod is caused by a rotary motion and an axial motion of the eccentrically-placed valve core. The rotary motion is for a purpose of making the forces borne by the three (or more) piston rods vary in sequence along with the rotary motion of the eccentrically-placed valve core. In the rotation process of the eccentrically-placed valve core, the entire axial displacement between the valve core and a valve seat is constant, but a relative distance between a concave part on the valve core and the valve seat is farther, and a relatively large pressure intensity may be produced at this part. A convex part of the valve core is closer to the valve seat, and the pressure intensity at this part is relatively reduced. When the valve core rotates, a pressure circulating field of which a pressure intensity varies in sequence and which is rotating is formed around the valve core, such that the forces borne by the three (or more) piston rods vary in sequence, and therefore, the ball-joint rod and the drill bit connected to the ball-joint rod continuously swing as the forces vary. The axial motion of the eccentrically-placed valve core is for a purpose of making the forces borne by the three (or more) piston rods vary in an amplitude of the bias angle with the axial motion of the eccentrically-placed valve core. That is, the axial motion of the eccentrically-placed valve core determines large-scale adjustment of the derivation angle of the drill bit, and the rotary motion of the eccentrically-placed valve core determines a rotation speed of the bias angle of the drill bit, and when this speed reaches a certain relation to the rotation speed of the drill stem, the drill bit drills towards one direction (generally speaking, the rotary motion of the eccentrically-placed valve core controls a "rocking back and forth" cycle of the drill bit and the axial motion of the eccentrically-placed valve core controls the amplitude of the "rocking back and forth" of the drill bit).

The rotation guidance apparatus of the present invention breaks through the problems in existing push-the-bit rotation guidance in China that the lateral force is large, the deflection rate is high, the drilled holes have large doglegs and track fluctuation and are not smooth, and a drill bit and a drill bit bearing are worn more seriously, and is of a design thought which is simpler in structure, easier to control and higher in reliability compared to a directional rotation guidance apparatus abroad. A new dynamic inwardly eccentrically-placed drill bit type (fully rotating, and a radial dimension of a tool will not undergo a locally expanded phenomenon) rotation guidance apparatus is formed in order to avoid the shortcomings existing in a static eccentrically-placed push-the-bit drill bit type (an outer barrel of a tool system does not rotate, for example, Auto TrakRCLS), a dynamic eccentrically-placed push-the-bit drill bit type (fully rotating, for example, Power Drive SRD), a static eccentrically-placed directional drill bit type (an outer barrel of a tool system does not rotate, for example, Geo-Pilot) and the like in the existing conventional rotation guidance technology. By providing an rotary eccentrically-placed valve core in a position, close to a drill bit side, of a drill stem to push a hydraulic piston push rod type rotation guidance apparatus to make a ball joint provided with a drill bit circumferentially rotate at 360 degrees within a certain deviation angle range, a brand-new directional rotation guidance apparatus is provided, which may control a "rocking back and forth" cycle of the drill bit by means of the rotation of the eccentrically-placed valve core and control the amplitude of the "rocking back and forth" of the drill bit by means of the axial motion of the eccentrically-placed valve core. When the eccentrically-placed valve core is entirely pulled back away from the piston holes, the drill bit can be used for straight drilling or stable inclination, and the nearer the eccentrically-placed valve core approaches the hydraulic piston holes, the stronger the deflection capacity, which can satisfy drilling of different radii of curvature. Therefore, the rotation guidance may be applicable to drilling of large curvature, and also may be used for drilling under a mean curvature and a small curvature, without a problem that a local radial dimension of a tool is expanded in a drilling process, such that a channel from which rock debris is discharged is more smooth, and the drilling safety and reliability are improved. Because of full rotation, the friction force between the drill stem and a well wall is reduced, and a horizontal well section may extend more deeply.

The present invention is not limited to the foregoing specific implementations. The present invention may be extended to any new feature or any new combination disclosed in the description, and any step of new method or process or any new combination disclosed.

The invention claimed is:

1. A rotation guidance apparatus, comprising an upper connector and a lower connector which are connected to each other, wherein an end part of the lower connector has a ball-socketed ball-joint rod, a drill bit which is connected to the ball-socketed ball-joint rod;

several circumferentially evenly distributed piston holes that are provided in a side wall of the lower connector, a piston which matches each of the piston holes, a piston rod connected to the piston being movably connected to the ball-socketed ball-joint rod;

wherein an eccentrically-placed valve core is connected to a controller provided inside the upper connector, a working face of the eccentrically-placed valve core being opposite to the piston holes, wherein rotation of the eccentrically-placed valve core makes the pistons in the piston holes move to control the rotation guidance of the ball-socketed ball-joint rod.

2. The rotation guidance device of claim 1, wherein the eccentrically-placed valve core is of an analogous conical structure, a cone surface of the eccentrically-placed valve core is provided with a concave part and a convex part, and when the eccentrically-placed valve core rotates, the concave part and the convex part are aligned to the piston holes respectively.

3. The rotation guidance apparatus of claim 2, wherein one end of the ball-socketed ball-joint rod is configured into a spherical structure which is matched with the end part of the lower connector by adopting a spherical surface to form a ball-joint structure, such that the ball-socketed ball-joint rod rotates relative to the lower connector by taking the ball-joint structure as a center, wherein the ball-socketed ball-joint rod is communicated with a central through hole of the lower connector to each other, a spline disc head is sheathed outside a middle part of the ball-socketed ball-joint rod, and the piston rod which matches each piston hole is movably connected to the spline disc head.

4. The rotation guidance apparatus of claim 2, wherein an accommodating groove which is communicated with the piston hole is provided in a position, in a middle of each piston hole, of the lower connector, and a hydraulic bag is provided inside the accommodating groove and is sealed in the accommodating groove via a hydraulic bag gland.

5. The rotation guidance apparatus of claim 2, wherein a central hole for accommodating a controller is provided in a middle of the upper connector, several bypass holes which are located in a same circumference are provided in a side wall of the upper connector, and the bypass holes, a central through hole of the lower connector and a central through hole of the ball-socketed ball-joint rod are communicated correspondingly to form a channel; and the eccentrically-placed valve core is located in a region, where the lower connector and the upper connector are connected, inside the channel.

6. The rotation guidance apparatus of claim 1, wherein one end of the ball-socketed ball-joint rod is configured into a spherical structure which is matched with the end part of the lower connector by adopting a spherical surface to form a ball-joint structure, such that the ball-socketed ball-joint rod rotates relative to the lower connector by taking the ball-joint structure as a center, wherein the ball-socketed ball-joint rod is communicated with a central through hole of the lower connector to each other, a spline disc head is sheathed outside a middle part of the ball-socketed ball-joint rod, and the piston rod which matches each piston hole is movably connected to the spline disc head.

7. The rotation guidance apparatus of claim 6, wherein a large ball joint gland connected to the lower connector is sheathed outside the ball-joint structure; a gland nut for limiting the spline disc head is sheathed outside the middle part of the ball-socketed ball-joint rod; an anti-drop connector sheathed outside the ball-socketed ball-joint rod is connected to one end, close to the drill bit, of the lower connector, and the minimum drift diameter of the anti-drop connector is greater than an outer diameter of the spline disc head.

8. The rotation guidance apparatus of claim 7, wherein an accommodating groove which is communicated with the piston hole is provided in a position, in a middle of each piston hole, of the lower connector, and a hydraulic bag is provided inside the accommodating groove and is sealed in the accommodating groove via a hydraulic bag gland.

9. The rotation guidance apparatus of claim 7, wherein a central hole for accommodating a controller is provided in a middle of the upper connector, several bypass holes which are located in a same circumference are provided in a side wall of the upper connector, and the bypass holes, a central through hole of the lower connector and a central through hole of the ball-socketed ball-joint rod are communicated correspondingly to form a channel; and the eccentrically-placed valve core is located in a region, where the lower connector and the upper connector are connected, inside the channel.

10. The rotation guidance apparatus of claim 6, wherein one end of each piston rod is ball-socketed to the spline disc head, a piston rod upper sealing packing is provided at the other end of the piston rod to form the piston, and the piston rod drives the piston rod upper sealing packing to move relative to the piston holes; and a piston rod lower sealing packing which moves in a relative sealing manner is sheathed outside the piston rod, and is fixed to the lower connector.

11. The rotation guidance apparatus of claim 10, wherein an accommodating groove which is communicated with the piston hole is provided in a position, in a middle of each piston hole, of the lower connector, and a hydraulic bag is provided inside the accommodating groove and is sealed in the accommodating groove via a hydraulic bag gland.

12. The rotation guidance apparatus of claim 10, wherein a central hole for accommodating a controller is provided in a middle of the upper connector, several bypass holes which are located in a same circumference are provided in a side wall of the upper connector, and the bypass holes, a central through hole of the lower connector and a central through hole of the ball-socketed ball-joint rod are communicated correspondingly to form a channel; and the eccentrically-placed valve core is located in a region, where the lower connector and the upper connector are connected, inside the channel.

13. The rotation guidance apparatus of claim 1, wherein an accommodating groove which is communicated with the piston hole is provided in a position, in a middle of each piston hole, of the lower connector, and a hydraulic bag is provided inside the accommodating groove and is sealed in the accommodating groove via a hydraulic bag gland.

14. The rotation guidance apparatus of claim 1, wherein a central hole for accommodating a controller is provided in a middle of the upper connector, several bypass holes which are located in a same circumference are provided in a side wall of the upper connector, and the bypass holes, a central through hole of the lower connector and a central through hole of the ball-socketed ball-joint rod are communicated correspondingly to form a channel; and the eccentrically-placed valve core is located in a region, where the lower connector and the upper connector are connected, inside the channel.

15. The rotation guidance apparatus of claim 14, wherein the controller comprises a rotating motor and a dragging motor which are located on a same axis inside the center hole; the eccentrically-placed valve core is provided at one end of an eccentrically-placed valve rod, the other end of the eccentrically-placed valve rod is connected to the rotating motor through a first transmission shaft, and the rotating motor is connected to the dragging motor through a second transmission shaft; and a control module is placed in a region, wherein a groove is formed, on the side wall of the upper connector, and the rotating motor and the dragging motor are connected to and controlled by the control module respectively.

16. The rotation guidance apparatus of claim 15, wherein a first motor sleeve and a motor support are provided in the central hole; the rotating motor is clamped inside the first motor sleeve, and bumps which are provided outside the first motor sleeve match a motor sleeve sliding groove in an inner wall of the central hole, such that the first motor sleeve slides relative to the central hole; and a first motor sleeve end cover is provided at a tail part of the first motor sleeve and matches the second transmission shaft through threads, and the second transmission shaft is connected to the dragging motor provided inside a second motor sleeve.

* * * * *